United States Patent [19]

Wong

[11] Patent Number: 4,810,982

[45] Date of Patent: Mar. 7, 1989

[54] COAXIAL TRANSMISSION-LINE MATRIX INCLUDING IN-PLANE CROSSOVER

[75] Inventor: Mon N. Wong, Torrance, Calif.

[73] Assignee: Hughes Aircraft Company, Los Angeles, Calif.

[21] Appl. No.: 111,901

[22] Filed: Oct. 23, 1987

[51] Int. Cl.[4] ..... H01P 5/18

[52] U.S. Cl. ..... 333/115; 333/117

[58] Field of Search ..... 333/109, 115, 116, 117

[56] References Cited

U.S. PATENT DOCUMENTS

| | | | |
|---|---|---|---|
| 3,478,281 | 11/1969 | Jeong | 333/116 |
| 3,654,570 | 4/1972 | Thomas | 333/33 X |
| 3,737,810 | 5/1973 | Shelton | 333/116 |
| 4,533,883 | 8/1985 | Hudspeth et al. | 333/1 |
| 4,647,878 | 3/1987 | Landis et al. | 333/115 |
| 4,704,590 | 11/1987 | Schneider | 333/115 |

FOREIGN PATENT DOCUMENTS

| | | | |
|---|---|---|---|
| 84/03395 | 8/1984 | PCT Int'l Appl. | 333/109 |
| 235114 | 6/1969 | U.S.S.R. | 333/116 |
| 2129624 | 5/1984 | United Kingdom | 333/116 |

*Primary Examiner*—Eugene R. LaRoche
*Assistant Examiner*—Benny Lee
*Attorney, Agent, or Firm*—Steven M. Mitchell; Mark J. Meltzer; A. W. Karambelas

[57] ABSTRACT

An assembly of coaxial tranmission lines and coupling devices, formed of closely spaced center conductors of the coaxial lines, is formed within a planar configuration. The coupling devices are arranged either singly, or in pairs with one coupling device behind the other coupling device, to provide for a division of power between transmission lines and to provide for a crossing over of power from one transmission line to another transmission line. The transmission-line assembly is reciprocal in operation so that the singly arranged coupling devices may be employed for a distribution as well as for a combination of electromagnetic waves. Phase shifters may also be included to provide a desired phase relationship among waves outputted by various ones of the transmission lines. The transmission lines, the coupling devices and the phase shifters may all be fabricated in a parallel array within a common metallic plate by automated milling machines for facile, accurate, and reproducible manufacture of the transmission-line assembly. The assembly including the matrix of coaxial lines for electromagnetic waves is readily structured to serve as a Butler matrix.

15 Claims, 8 Drawing Sheets

COAXIAL TRANSMISSION-LINE MATRIX INCLUDING IN-PLANE CROSSOVER

BACKGROUND OF THE INVENTION

This invention relates to a matrix of coaxial transmission lines, particularly a Butler matrix for the distribution of electromagnetic energy from one of a plurality of input ports to a plurality of output ports and, more particularly, to a set of coaxial transmission lines constructed in a unitary assembly wherein paired coupling devices formed of closely spaced center conductors of adjacent coaxial lines including a crossed configuration of the center conductors provide for in-plane crossing of power from one transmission line to another transmission line.

In the processing of electromagnetic signals, it is frequently advantageous to distribute and combine algebraically signals propagating in a set of waveguides. A common example of such combination is found in the feeding of antenna elements in an array antenna in which each element is fed microwave energy via a coaxial transmission line. As is well known, the contributions of electromagnetic energy applied to each of the antenna elements radiate as waves, and combine to form a beam upon suitable phasing of the waves radiated by the respective elements. The difference in phase among waves of the various elements, sometimes referred to as a phase taper or phase slope, can be selected to adjust a direction of radiation of the beam from the antenna.

One form of microwave distribution system for distributing the electromagnetic energy among the antenna elements is composed of a set of lines for transmission of electromagnetic energy interconnected to form a matrix of paths for the conduction of electromagnetic energy, the composite transmission-line structure being known as a Butler matrix. The Butler matrix is well known and may be used for coupling, by way of example, a set of four input ports to a set of four output ports, a set of eight input ports to a set of eight output ports, or other number of ports such as sixteen input ports to sixteen output ports. Assuming by way of further example that the output ports are connected to an array antenna, and that the input ports are connected via a selector switch to a transmitter, energization of any one of the input ports with electromagnetic power provides for a uniform distribution of the electromagnetic power among the full set of output ports to provide for a radiated beam from the antenna. The direction of the beam relative to the array of antenna elements differs with each selected one of the input ports. Thereby, by operation of the selector switch, a beam may be generated in any desired one of a set of possible directions. The Butler matrix is reciprocal in operation so that a receiving beam of radiation can be outputted at any one of the input ports for coupling by the selector switch to a receiver.

A Butler matrix is composed of numerous 3 dB (decibels) couplers interconnecting transmission lines whereby power in one transmission line can be distributed equally between one transmission line and a second transmission line. A 90 degree phase shift is introduced at the coupler between waves carrying each half of the power. Therefore, various phase relationships exist among waves traveling in the various transmission lines. In order to provide for a desired phase taper at the output ports for forming a beam on transmission, and in order to sum together the contributions from various antenna elements during reception of an incoming electromagnetic wave, additional phase shifters are connected into the waveguides. A further aspect in the construction of a Butler matrix is the presence of numerous crossovers in which one transmission line is provided with twists and turns to cross over another transmission line, thereby to allow interconnection and coupling of signals between various combinations of the transmission lines.

A problem arises in the construction of a Butler matrix, or other matrix of transmission lines employed for the algebraic combination of electromagnetic waves, in that the manufacture of an assembly of transmission lines with twists and turns to effect a crossover is difficult. Furthermore, in the case of a matrix interconnecting many input ports with many output ports, there are crossings of transmission lines above other crossed over transmission lines resulting in a microwave structure of highly irregular shape and excessively large size which is difficult to incorporate into a microwave system.

SUMMARY OF THE INVENTION

The foregoing problem is overcome and other advantages are provided by a transmission-line matrix having a planar construction in accordance with the invention. The matrix is constructed by placing the transmission lines in a side-by-side array in an assembly sharing a common base plate and a common cover plate, the base plate being formed with a set of channels in which are disposed a corresponding set of center conductors to define a set of coaxial transmission lines.

In accordance with the invention, hybrid couplers structures are disposed between adjacent ones of the coaxial transmission lines for dividing the power of one transmission line among two transmission lines, or alternatively, for combining the power of two transmission lines into one transmission line.

Furthermore in accordance with the invention, the assembly of transmission lines includes crossovers by which electromagnetic power in one transmission line can be routed past an adjacent transmission line to be placed in a third transmission line, the crossing over being accomplished within the confines of the planar configuration of the assembly and without necessitating any increased height to the structures of the crossovers as compared to that of an individual coaxial line. This permits the microwave circuit, including coaxial transmission lines, hybrid couplers, and crossovers, to be constructed in a planar microwave configuration. The planar configuration of each of the crossovers is attained by connecting two hybrid couplers in tandem wherein each of the hybrid couplers divides the power of an incoming electromagnetic wave into two waves of equal power with a 90 degree phase shift between the two waves. Each of the hybrid couplers has two input ports and two output ports, the output ports of a first one of the two couplers being connected to the input ports of a second one of the two couplers.

The arrangement of the interconnection of the two couplers is accomplished by constructing all conduits of electromagnetic power within a single planar configuration, in accordance with a feature of the invention, by use of a coupler having two input ports on a front side of the coupler and two output ports on a back side of the coupler. Such a coupler is constructed by use of coaxial transmission lines connecting to the ports of the coupler and wherein, within a housing of the coupler, diametrically opposed pairs of input and output ports are connected by a pair of crossed insulated, electrically-conducting rods or bars which are spaced apart by a uniform narrow gap to provide for capacitive coupling of electromagnetic power between the two bars.

A planar configuration for the crossing of the two bars is attained by the construction of a notch in a central region of each bar, the notch of one bar facing the notch of the other bar at the site of the crossover with one notch engaging with and enveloping the other notch while maintaining a gap between the walls of the notch, through which gap there is capacitive coupling of electromagnetic power. The configuration of the crossover has the effect of creating a half twist to the two bars, in a manner similar to a twisted pair of electrical conductors, this resulting in a relocation of one input port and one output port so as to place both input ports on the front side of the housing and both output ports on the back side of the housing.

At various locations within the microwave assembly, at each of the crossovers, the crossing over of an electromagnetic wave has been accomplished in a common plane of the coaxial transmission lines, and without the introduction of any twisting and turning of a transmission line, as has been required heretofore to effect a crossing over of a wave from the position of one transmission line to the position of another transmission line.

The resulting transmission-line structure has a much simpler form than has been possible heretofore because all of the transmission lines and the microwave components, such as couplers, phase shifters, and crossovers, lie within a common plane. Such structure is readily incorporated into a microwave system and allows for a compact emplacement of components of the system. A further advantage is obtained from the planar configuration because all of the transmission lines can be formed of channels with center conductors, the channels serving as outer conductors and being milled out of a single metal plate. For example, in a preferred embodiment of the invention, the channels are milled out of a base plate of aluminum, the microwave components including the center conductors are inserted into the channels, and the assembly is completed by a closing of the channels with an aluminum cover plate. This allows the transmission line assembly to be made by numerically controlled milling machines, and also allows for many coaxial transmission-line matrices to be constructed readily with identical electrical characteristics.

BRIEF DESCRIPTION OF THE DRAWING

The aforementioned aspects and other features of the invention are explained in the following description, taken in connection with the accompanying drawing wherein.

DETAILED DESCRIPTION

In the figures, the first nine figures disclose the construction of a planar crossover of coaxial transmission lines suitable for use for in the construction of a planar matrix coaxial transmission lines in accordance with the invention. FIGS. 10–13 show the construction of the matrix of coaxial transmission lines. The description of the construction of the invention will begin, therefore, with a description of a pair of couplers of coaxial transmission lines formed as a unitary crossover assembly suitable for use in the construction of circuits of coaxial transmission lines and, in particular, in the construction of the transmission-line matrix of the invention. The description of the crossover is then followed by a description of the construction of the transmission-line matrix.

Figure 1:
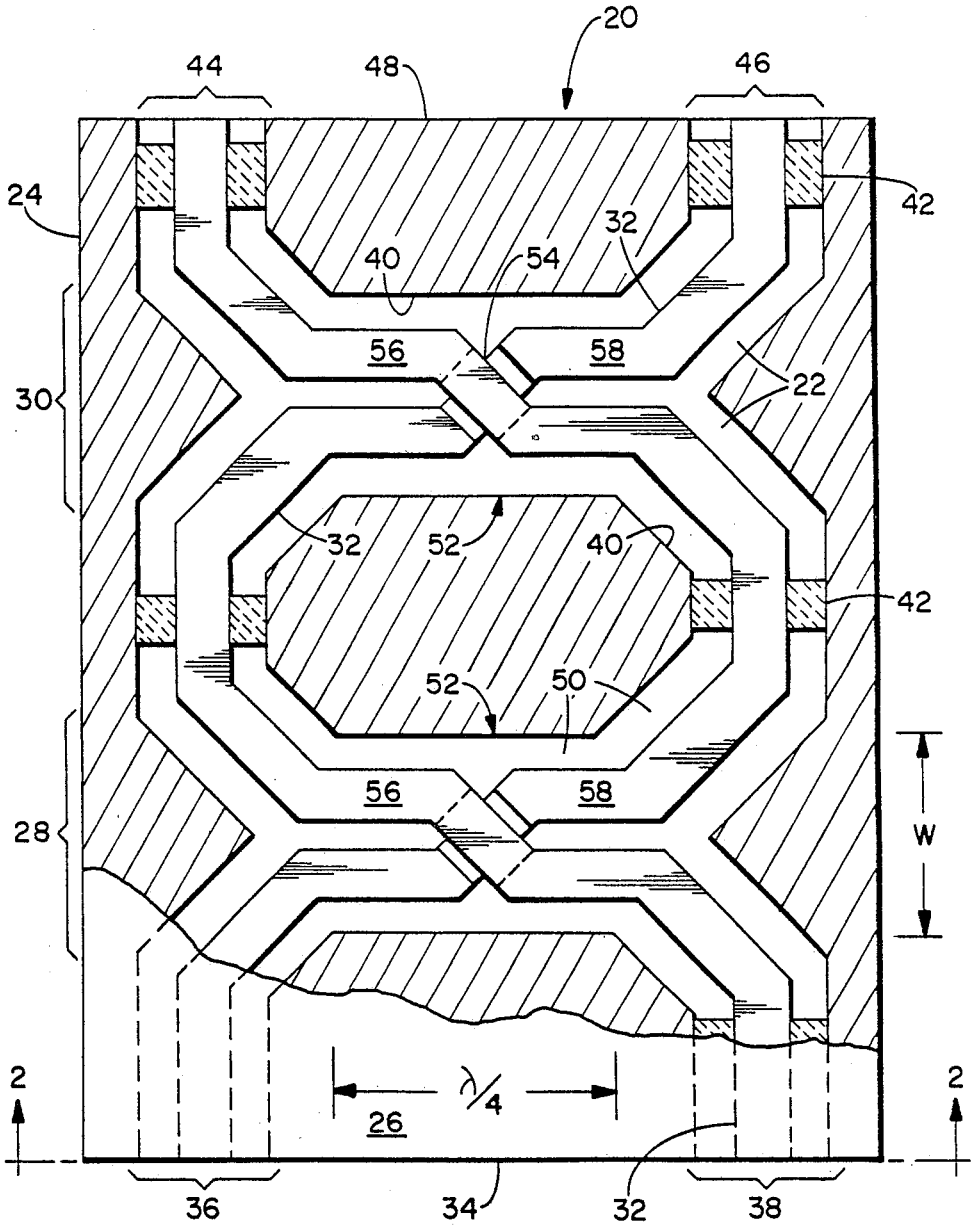
FIG. 1 is a plan view of the crossover of the invention formed within a planar configuration of a metallic base plate with a cover plate shown partially cutaway to expose the central conductors of coaxial transmission lines.
Figure 2:
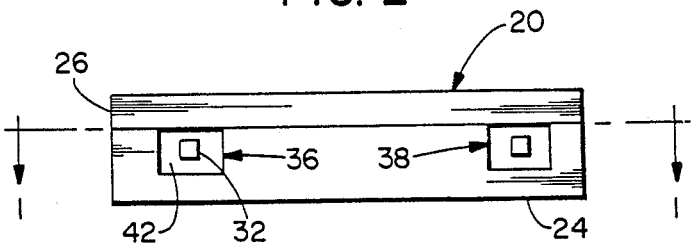
FIG. 2 is an end view of the crossover taken along the line 2—2 in FIG. 1.

FIGS. 1 and 2 show a crossover 20 formed of coaxial transmission lines 22 disposed within a base plate 24 covered by a cover plate 26. In accordance with the invention, the crossover 20 comprises two hybrid couplers 28 and 30 which are formed of crossed sections of a center conductor 32 of coaxial lines 22. FIG. 2 shows a front end 34 of the crossover 20, the view of FIG. 2 showing a first input port 36, a second input port 38, and the cover plate 26 disposed on top of the base plate 24. In FIG. 1, a portion of the cover plate 26 is shown, and the balance of the view is shown sectioned beneath the top surface of the base plate 24, as indicated in FIG. 2. The square cross section of center conductors 32, as well as the square cross section of the inner surface of the outer conductor 40 of the transmission lines 22 are also shown in FIG. 2. It should be noted that, while the square cross sectional configuration of the transmission lines 22 is employed in the preferred embodiment of the invention, the teachings of the invention are applicable also to rectangular coaxial transmission lines. Dielectric supports 42 position the center conductors 32 within the outer conductors 40 and insulate the center conductors from the outer conductors. To facilitate the description in FIG. 1, only a few of the supports 42 are shown, it being understood that such supports may be positioned in various locations along the transmission lines, and may be given a well-known physical configuration which negates reflection of electromagnetic waves.

Each of the hybrid couplers 28 and 30 provide for a splitting of an electromagnetic wave into two waves of equal power, wherein the two waves differ in phase by 90 degrees. As will be explained herein, each of the couplers 28 and 30 are fabricated in accordance with a feature of the invention which provides that two input ports are located on a front end of each of the couplers, and two output ports are located on the back end of each of the couplers. By way of example, the two input ports 36 and 38 of the crossover 20 also serve as input ports to the coupler 28. A similar pair of output ports, namely, a first output port 44 and a second output port 46, are located at the back end 48 of the crossover 20. The output ports 44 and 46 also serve as output ports of the coupler 30. The couplers 28 and 30 are of identical construction.

As may be seen by the layout of the couplers 28 and 30 presented in FIG. 1, and by the end view presented in FIG. 2, the coaxial transmission lines 22 are fabricated in a convenient fashion by milling out channels 50 within the base plate 24 to provide the outer conductors 40 of the transmission lines 22. The center conductors 32 are then emplaced within the channels 50, and supported in their respective positions by the supports 42. Thereupon, the assembly is completed by installing the cover plate 26 on top of the base plate 24. Both the base plate 24 and the cover plate 26, as well as the center conductors 32, may be fabricated of an electrically conducting material which is readily machined, such as aluminum.

Figure 9:
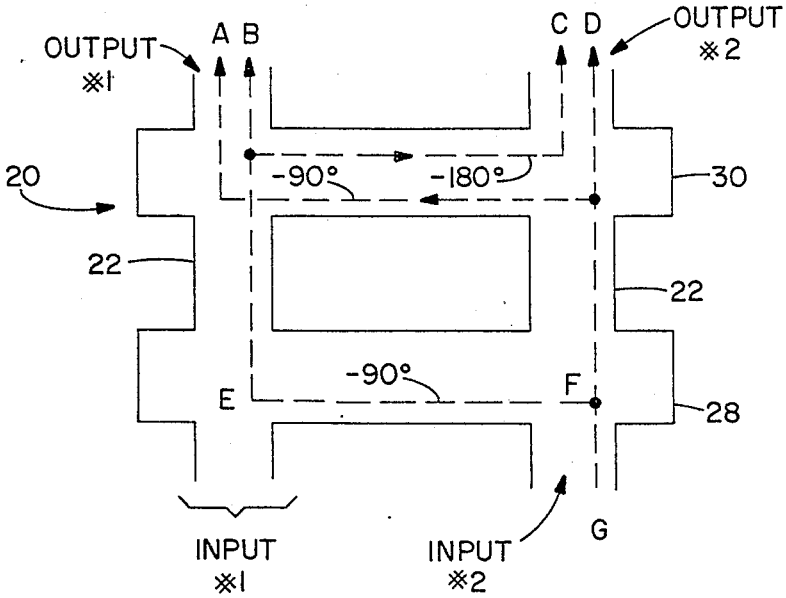
FIG. 9 is a diagrammatic representation of the tandem arrangement of the two couplers of FIG. 1 including paths of electromagnetic waves useful in explaining operation of the crossover.
Figure 10:
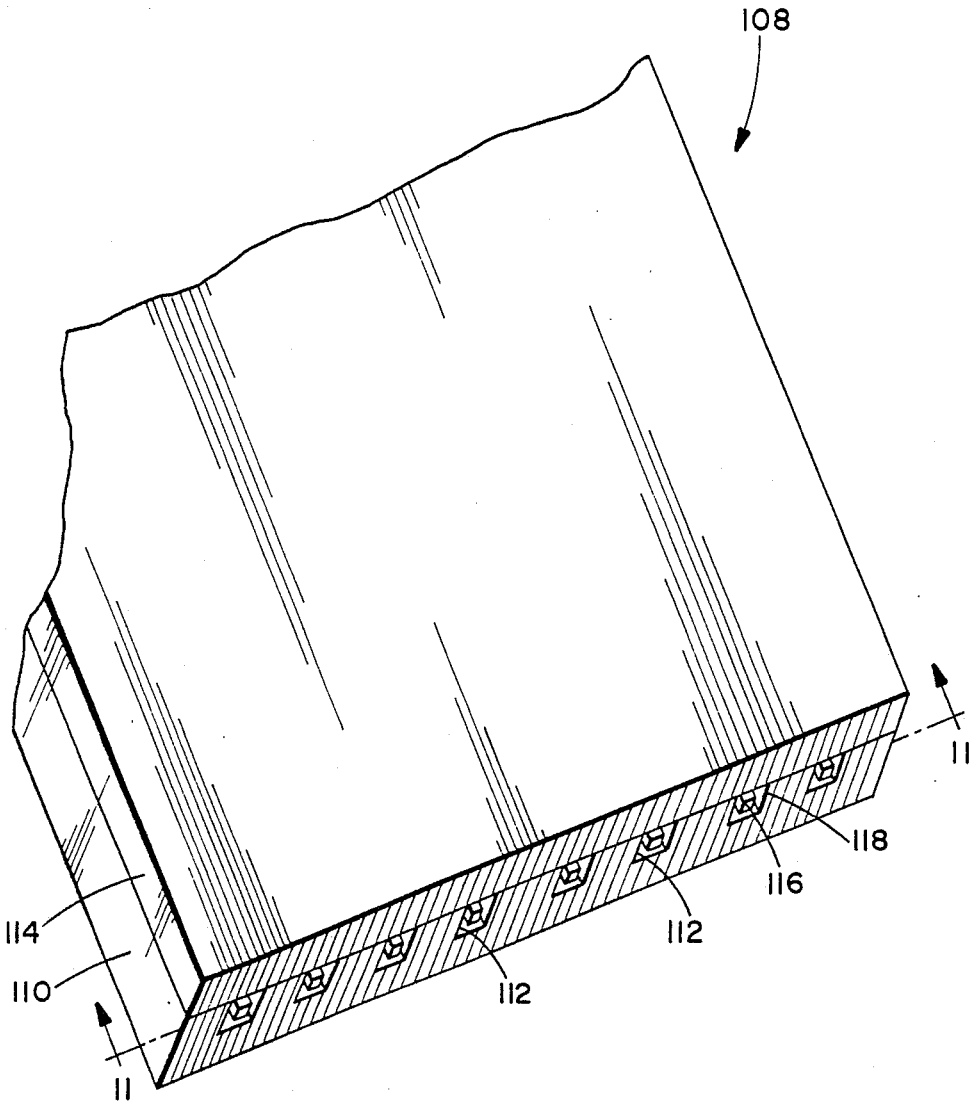
FIG. 10 is a stylized isometric view of a planar square coaxial assembly incorporating a transmission line matrix in accordance with the invention.

As will be explained in further detail hereinafter with reference to FIG. 9, the crossover 20 acts to couple an electromagnetic wave from one of the input ports to the diagonally opposite output port, for example, from the second input port 38 to the first output port 44. This is accomplished by virtue of the even splitting of power at each of the couplers 28 and 30 with the phase lag of 90 degrees, this resulting in a cancellation of waves at one of the output ports so that all of the power of the input wave exits from the other output port.

It is noted that a particular feature of the invention is the construction of the crossover 20 including all components of the couplers 28 and 30 and their interconnecting transmission lines 22 within a single assembly of planar configuration. This is made possible because of the presence of both input ports of a coupler on the front end of the coupler, and the presence of both output ports on the back end of the coupler. This arrangement of the ports of each of the couplers 28 and 30 allows for the interconnection of the couplers via the transmission lines 22 as shown in the layout of FIG. 1, the layout disclosing that all connections are accomplished within a common planar configuration without the need for any transmission lines located outside of the assembly of FIG. 1. Both the plates 24 and 26 are of planar configuration and serve to form a housing of planar configuration for the coupler 28 and for the coupler 30.

These novel features are a direct consequence of the novel construction of each of the couplers 28 and 30, which construction will now be described in accordance with the invention.

With reference to FIGS. 1–5, the coupler 28 is formed with a central region 52 having a crossover 54 of two center conductors 32. Since both of the couplers 28 and 30 have identical construction, only the coupler 28 will be described in detail, it being understood that the description of the coupler 28 applies equally well to the coupler 30. In the central region 52, each of the center conductors 32 takes the form of a bar, there being two such bars 56 and 58 in the central region 52 and at the crossover 54. At the crossover 54, one bar crosses above the other bar which, by way of example, is portrayed in FIG. 3 by a crossing of the bar 56 above the bar 58.

Figure 4:
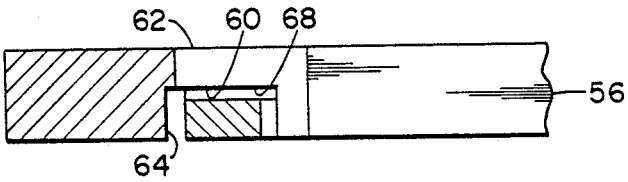
FIGS. 4 and 5 show sectional views taken along lines 4—4 and 5—5, respectively, in FIG. 3 to show details of bars in the crossover region of one of the couplers of the crossover.
Figure 5:
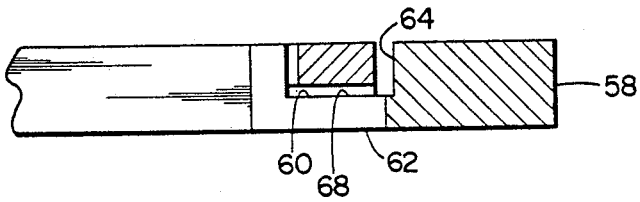

The crossover 54 is accomplished within the planar configuration by notching each of the bars 56 and 58 with notches 60 which face each other and allow the bars 56 and 58 to pass through each other at the notches 60 within the confines of the thickness of the bar 56 and the bar 58 as is shown in the side views of FIGS. 4 and 5. The notches 60 are sufficiently large to provide for clearance between the bars 56 and 58 at the crossover 54, the clearance maintaining electrical insulation between the two bars 56 and 58.

Figure 3:
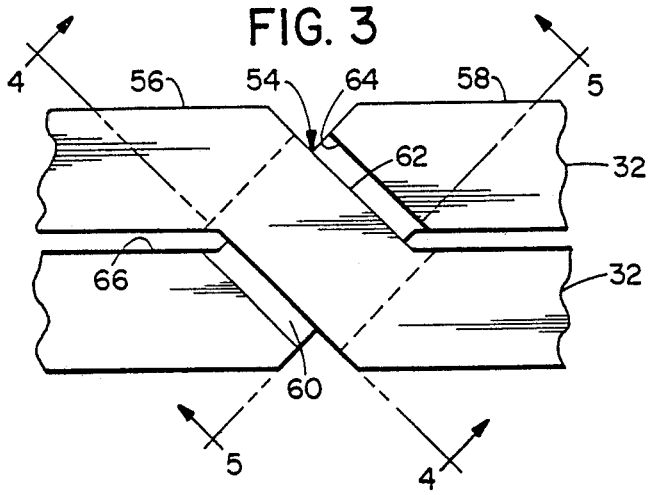
FIG. 3 is an enlarged plan view of a fragmentary portion of one of two hybrid couplers of the crossover of FIG. 1.

In FIG. 4, the bar 56 is shown to be notched at its bottom side, while FIG. 5 shows that the bar 58 is notched at its top side. As shown in FIGS. 1 and 3, the bars 56 and 58 are parallel to each other except at the crossover 54 where each of the bars undergoes a 45 degree change in direction so as to cross the other bar at an angle of 90 degrees. In each of the bars 56 and 58, the notch 60 is located at a crossing strip 62, the crossing strip 62 introducing a reverse curve to the bar by virtue of two turns of 45 degrees in opposite directions. The depth of each notch 60 is somewhat greater than the thickness of the bar 56, 58 so as to provide clearance in the vertical direction between the strips 62 of the two bars 56 and 58. Clearance is also provided in the horizontal (parallel to the plane of the base plate 24) direction between a strip 62 of one of the bars and the sides 64 of the notch 60 in the other of the two bars.

The clearance between the two crossing strips 62 at the central portions of the bars 56 and 58, and clearance between parallel end portions of the bars 56 and 58 are selected to produce a desired amount of capacitance for coupling electromagnetic power between the bars 56 and 58. At an operating frequency in the range of 3.7–4.2 GHz (gigahertz) wherein the free-space wavelength of the radiation has a nominal value of three inches, the clearance between the parallel end portions of the bars 56 and 58 is selected to define a gap 66 having a width of 30 mils. A larger clearance is provided at the crossover 54 such that the spacing between the crossing strips 62 as well as between a crossing strip 62 and sides 64 of a notch 60 are each equal to 50 mils. The larger clearance at the crossover 54 reduces the capacitance to the crossover 54 so as to equalize the amount of capacitance per unit length of the bar 56 or 58 throughout the length of the bar including both the end portion and the region of the crossover 54. It is noted that, in the absence of such increased clearance at the crossover 54, the added length of gap along the sides 64 of a notch plus the bottom 68 of a notch 60 tends to increase the amount of capacitance at the crossover 54. It is desired to maintain uniform capacitance in the central region 52 of the coupler 28 so as to minimize reflection of electromagnetic waves and insure a low value of VSWR (voltage standing wave ratio). The foregoing increase of clearance at the crossover 54 produces the desired reduction in the capacitance at the crossover 54 so as to equalize the capacitance per unit length of bar.

In terms of operation of the coupler 28, the configuration of the crossed bars 56 and 58 in FIG. 3 has the form of a twisted pair of electrical conductors wherein only one half twist is provided. Therefore, the two bars 56 and 58 may be viewed as a pair of parallel bars through which electromagnetic power is coupled. The location of input and output ports of the coupler 28 follows the twisting of the bars 56 and 58. In addition, the implementation of the twist, as is provided by the crossover 54, maintains electromagnetic coupling between the two bars 56 and 58 so that the desired amount of coupled power is maintained, independently of the twisting of the bars 56 and 58. Thereby, the coupler 28 can provide for a division of the electromagnetic power of a wave incident upon the coupler 28 into two waves of equal power outputted from the coupler 28 in substantially the same fashion as though the bars 56 and 58 were totally straight. Thus, by construction of the crossover 54 to implement a twisting of the bars 56 and 58, the effect in the operation of the coupler 28 is to interchange locations of input and output ports, in accordance with the invention, such that the two output ports are on the same side, namely the back side of the coupler 28, while the two input ports also share a common side, namely the front side of the coupler 28. This provides the coupler 28 with the requisite locations of input and output ports to allow the arrangement of interconnection between the two couplers 28 and 30 in a planar configuration as shown in FIG. 1.

It is also noted that, while the coupler 28 has been described for use with the crossover 20, the coupler 28 may also be employed in other microwave circuits for performing algebraic combinations of electromagnetic signals. Since the coupler 28 is reciprocal in its operation, it may be employed for both division of power in one wave among two other waves, as well as for combining the power of two waves into one wave. Also, the above noted gap width which has been established for a 3 dB coupling of power can be enlarged to provide for a coupling of smaller amounts of power. In the preferred embodiment of the invention, the following cross sectional dimensions of the transmission lines 22 are employed; the center conductor 32 in cross section measures 0.2 inches on a side, and the outer conductor 40 in cross section measures 0.5 inch on a side. The length of the bars 56 and 58, as portrayed in FIG. 1, is one-quarter wavelength of the electromagnetic energy propagating along the transmission lines 22. The width W (FIG. 1) of a channel 50 is enlarged at the coupler 28 to provide room for both of the center conductors 32, the width being increased by the width of one outer conductor 40. The form of electromagnetic wave propagating along a coaxial transmission line 22 is a TEM (transverse electromagnetic) wave. The impedance of a transmission line 22 is 50 ohms.

Figure 6:
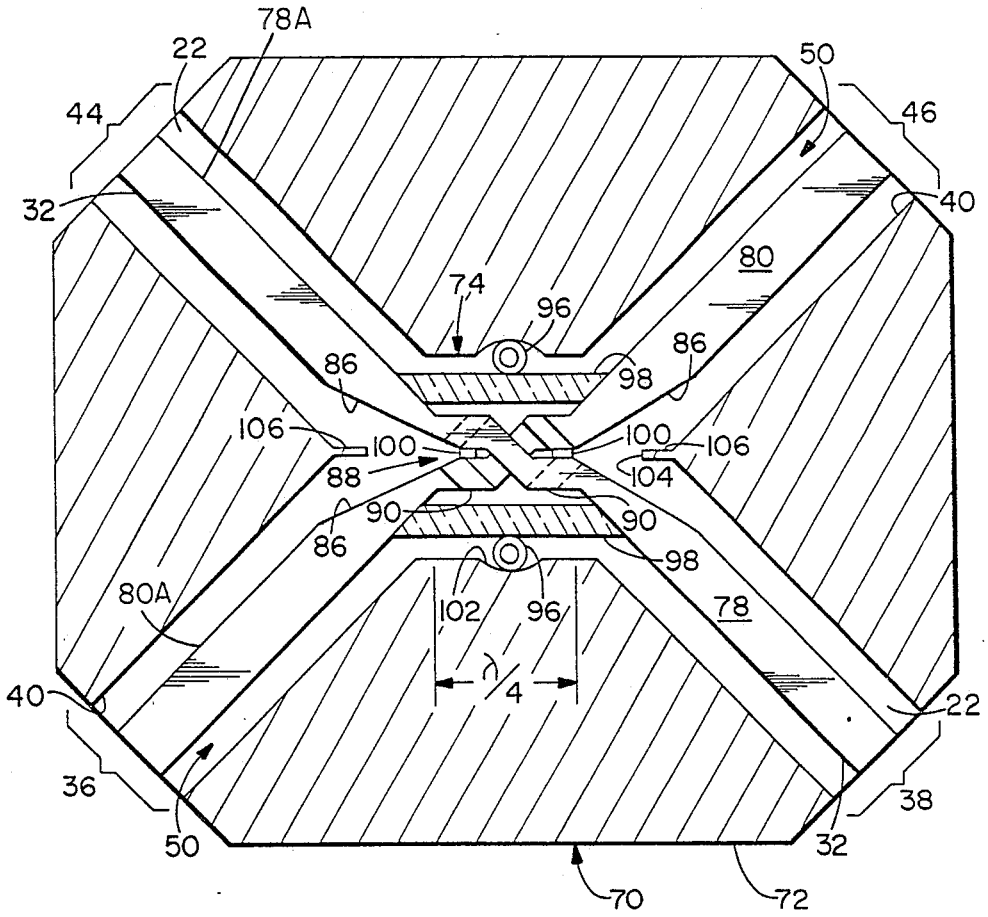
FIG. 6 is a view, similar to that of FIG. 3, showing an alternative embodiment of the crossover region of a coupler.

FIG. 6 shows a view of a hybrid coupler 70 which is an alternative embodiment of he hybrid coupler 28 of FIG. 1. The coupler 70 is fabricated in the same way as the coupler 28, and is formed of a base plate 72 in which channels 50 have been milled out to form the outer conductors 40 of coaxial transmission lines 22, the lines 22 including a center conductor 32, as was disclosed in the construction of the hybrid coupler 28 of FIG. 1. The view of FIG. 6 shows a layout of the components of the coupler 70 and has been formed by taking a section through the base plate 72 parallel to the top surface thereof, as was done in the sectioning of the view of FIG. 1.

In the event that the coupler 70 is to be employed in the construction of a microwave crossover circuit, such as the crossover 20 of FIG. 1, then the base plate 72 would be extended to include two of the couplers 70 with interconnecting transmission lines 22 in the same fashion as is disclosed for the construction of the crossover 20 of FIG. 1. The configuration of the base plate 72, as shown in FIG. 6, suffices for the creation of the two input ports 36 and 38 and the two output ports 44 and 46 for each of the two couplers 70. These ports may be employed for connection of the coupler 70 to various microwave circuits or components such as another hybrid coupler. As was the case with the coupler 28, the input ports 36 and 38 of the coupler 70 are directed towards the front of the coupler, while the output ports 44 and 46 of the coupler 70 are directed towards the back of the coupler. The cross sectional dimensions of the center conductor 32 and the outer conductor 40 in each of the transmission lines 22 are the same as that disclosed for the coupler 28 of FIG. 1. It should be noted that the description of the construction of the coupler 70, as well as of the coupler 28, can also be employed for coaxial transmission lines in which the center conductors have a nonrectangular cross-sectional shape such as a circular or elliptical shape. However, the rectangular or square shape is preferred for 3 dB couplers wherein an input wave divides into two output waves of equal power.

The coupler 70 includes a central region 74 which differs from the central region 52 of the coupler 28 by the provision of a crossing strip 76 in each of two bars 78 and 80 (FIG. 7) which are narrower than the corresponding crossing strips 62 in the bars 56 and 58 of the coupler 28. The bars 78 and 80 of the coupler 70 (FIG. 6) correspond respectively to the bars 56 and 58 of the coupler 28 (FIGS. 1 and 3).

A further difference between the central region 74 and 52 is the provision in the central region 74 of a notch 82 in each of the bars 78 and 80 which has a stepped sidewall 84 (FIGS. 7 and 8) instead of the straight side 64 (FIGS. 3, 4, and 5) of the notch 60. Yet a further distinction between the central regions 74 and 52 is the inclusion at the edge of the central region 74 of tapers 86 (FIGS. 6 and 7) on extension or wing portions 78A, 80A of the bars 78 and 80 approaching a crossover 88 (FIG. 6), such tapers being absent in the coupler 28 of FIG. 1. The foregoing differences in structure between the couplers 70 and 28 provide the coupler 70 with a better VSWR, and also increases the operating bandwidth of the coupler 70 as compared to the coupler 28.

Figure 7:
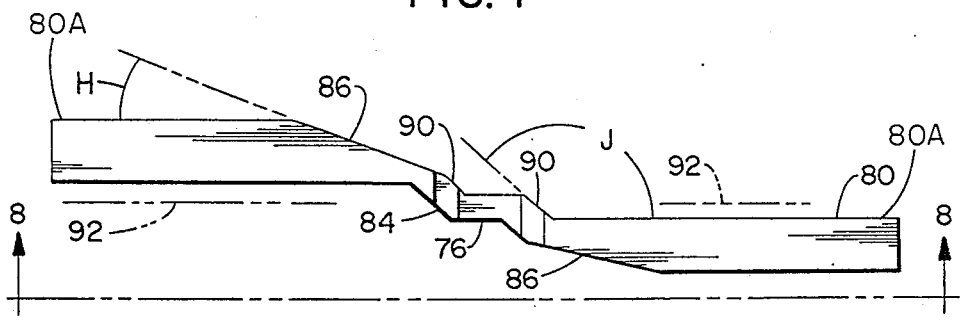
FIGS. 7 and 8 show, respectively, a plan view and a side view of a bar in the alternative embodiment of the coupler of FIG. 6.
Figure 8:
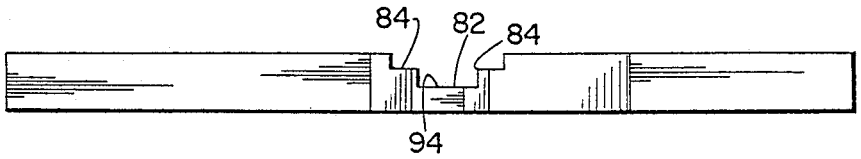

As may be seen by inspection of FIGS. 6 and 1, the bars 78 and 80 have a more complex structure than the bars 56 and 58. It should be noted that the two bars 78 and 80 have the same physical shape, the geometry of the bar 80, as portrayed in FIG. 6, being obtained by turning the bar 78 upside down. Specific details in the construction of the bar 78 and 80 may be obtained by reference to the detailed views of the bar 80 in FIGS. 7 and 8. As the bar 80 extends inwardly from the extensions 80A thereof, the width of the bar 80 is reduced by the taper 86 to a value of approximately one-half the original width such that the width of the crossing strip 76 is approximately 0.1 inch, as compared to 0.2 inches width at the ends of the bar 80. The crossing strip 76 is joined by necks 90 (FIG. 7) which are angled relative to the strip 76 so as to offset both extensions of the bar 80 on opposite sides of a central axis 92 of the bar 80. Both extensions of the bar 80, and the strip 76 are parallel to the axis 92, the strip 76 being centered on the axis 92. Inclination of a neck 90 relative to an extension 80A of the bar 80 is shown in FIG. 7 by an angle J equal to 135 degrees. The inclination of both of the necks 90 to their respective bar extensions are the same. Inclination of a taper 86 relative to a straight edge of an extension of the bar 80 is shown in FIG. 7 by an angle H equal to 22.5 degrees. Both of the tapers 86 in the bar 80 have the same inclination.

The crossover 88 (FIG. 6) is similar to the crossover 54 (FIGS. 1 and 3) in that, in both cases, the crossing strip of one bar is enveloped by the notch of the other bar. As may be seen in FIGS. 7 and 8, a bottom 94 of the notch 82 is sufficiently wide to extend beyond the side edges of the crossing strip 76 in the crossover 88 (FIG. 6). Steps of the stepped sidewalls 84 extend still further back from the sides of the crossing strip 76 in the crossover 88. Beyond the region of the crossover 88 and the necks 90, the bars 78 and 80 broaden to their initial width. Thus, the necks 90 and the crossing strip 76 can be viewed as an isthmus which joins the broader extensions or wing portions of each of the bars 78 and 80.

As shown in FIG. 6, the bars 78 and 80 are held in position by means of two springs 96, two dielectric supports 98, and a pair of dielectric spacers 100. The springs 96 are secured within pockets 102 in a sidewall of a channel 50. The springs 96 urge the supports 98 towards each other and against the bars 78 and 80. The spacers 100 are oriented vertically with respect to the plane of the base plate 72 and are disposed between facing sides of paired necks 90, there being one spacer 100 on opposite sides of the crossover 88. The spacers 100 resist the forces exerted by the springs 96 as the bars 78 and 80 are urged together, thereby tightly holding the bars 78 and 80 in their respective positions for maintaining a desired clearance between the necks 90 of the bars 78 and 80, and between the corresponding portions of the crossing strips 76 and the notches 82 at the crossover 88. As was the case with gaps and spacings disclosed above with reference to the coupler 28, corresponding values are employed in the coupler 70 of FIG. 6. Thus, the spacers 100 have a thickness of 30 mils, and the vertical spacing between the bottom 94 of a notch 82 and the facing side of a crossing strip 76 is 50 mils. With respect to the dimensions of the steps of the stepped sidewall 84 (FIG. 8), the depth of the step is approximately one-third the depth of the bottom 94 of the notch 82, while the horizontal portion of the step is approximately one-third the width of the bottom 94.

An iris 104 (FIG. 6) is provided by two vanes 106 extending inwardly towards the crossover 88 from outer sidewalls of channels 50, the vanes 106 being coplanar with the spacers 100. The iris 104 serves to limit the region through which electromagnetic power from an input port 36, 38 can couple to both of the output ports 44 and 46. The length of the foregoing isthmus (the two necks 90 plus the crossing strip 76) is one-quarter wavelength of the electromagnetic waves propagating along the transmission lines 22, this length being less than the cross-sectional dimension of the iris 104. In terms of the operation of the coupler 70, it is noted that the amount of power coupled between the bars 78 and 80 depends on the capacitance between the two bars, this being determined primarily by the coupling at the spacers 100 at the crossover 88, while the difference in phase imparted between waves outputted at the ports 44 and 46 is determined by interaction of electromagnetic waves across the entire distance of the iris 104. The material employed in the supports 98 and the spacers 100 is preferably a plastic material having a dielectric constant of approximately 3.2, one such material being marketed by General Electric under the trade name of ULTEM 1000, this material being dimensionally stable, even at high temperatures.

Operation of the crossover 20 of FIG. 1 constructed with the hybrid couplers 28 and 30 is the same as the operation of the crossover 20 with two couplers 70 substituted for the couplers 28 and 30. This operation is explained with the aid of the diagrammatic representation of FIG. 9 which shows the two couplers 28 and 30 wherein output ports of the coupler 28 are connected via transmission lines 22 to corresponding input ports of the coupler 30. Also shown in FIG. 9 are the two input ports and the two output ports of the crossover 20. In this explanation of the operation, it is presumed that a wave enters the second input port at point G, and propagates along paths indicated by dashed lines. Key points on the dashed lines are indicated at E and F in the coupler 28, and four waves resulting by operation of the couplers 28 and 30 appear at points A, B, C, and D at the two output ports of the crossover 20.

In operation, the input wave at G splits at the coupler 28 into two waves E and F having equal power, which power is equal to one-half of the original power at G. The wave at E is shifted 90 degrees lagging relative to the wave at F. At the coupler 30, the wave E splits into two components B and C having equal power, the power in the wave components B and C each being equal to one-quarter of the input power at G. Similarly, the wave at F is split by the coupler 30 into two wave components A and D having equal power, the power in each of the waves A and D being equal to one-quarter of the power at G. The wave at C is shifted in phase by a lagging ninety degrees relative to the wave at B. Similarly, the wave at A is shifted in phase by a lagging 90 degrees relative to the wave at D. As a result of the phase shifting, the wave component at C has undergone two ninety-degree phase shifts for a total phase shift of 180 degrees. Therefore, the wave component C destructively interferes with the wave component D resulting in a cancellation of all power outputted at the second output port. Therefore, none of the power of the wave at E is coupled from the left side of the coupler 30 to the right side of the coupler 30; all of the power at E exits the first output port. Similarly, none of the power at F exits the second output port, all of the power being coupled from the right side of the coupler 30 to the left side of the coupler 30 to exit at the first output port. Since the coupling of power via the couplers 28 and 30 each introduce a lagging phase shift of 90 degrees, the contributions via both couplers 28 and 30 are in phase at the first output port, the two contributions at A and B each having a lagging phase shift of 90 degrees. Thus, the two contributions at A and B add cophasally to produce an output power at the first output port equal to the power inputted at the second input port. The wave outputted at the first output port has a lagging phase of ninety degrees relative to the phase of the wave inputted at the second input port.

In accordance with the invention, and with reference to FIGS. 10–13, there is shown a transmission-line assembly 108 providing a matrix of paths for propagation and distribution of electromagnetic power, and including planar crossovers, as will now be described. The assembly 108 comprises a base plate 110 having channels 112 formed therein and being covered by a cover plate 114. Within each channel 112 there is disposed a center conductor 116 which, together with an outer conductor 118, formed by the walls of a channel 112, and the bottom surface of the cover plate 114 constitute a coaxial transmission line 120. In a preferred embodiment of the invention, the coaxial transmission line 120 has a square cross section of the outer conductor 118 and the center conductor 116 is formed as a rod of uniform square cross section.

Figure 11:
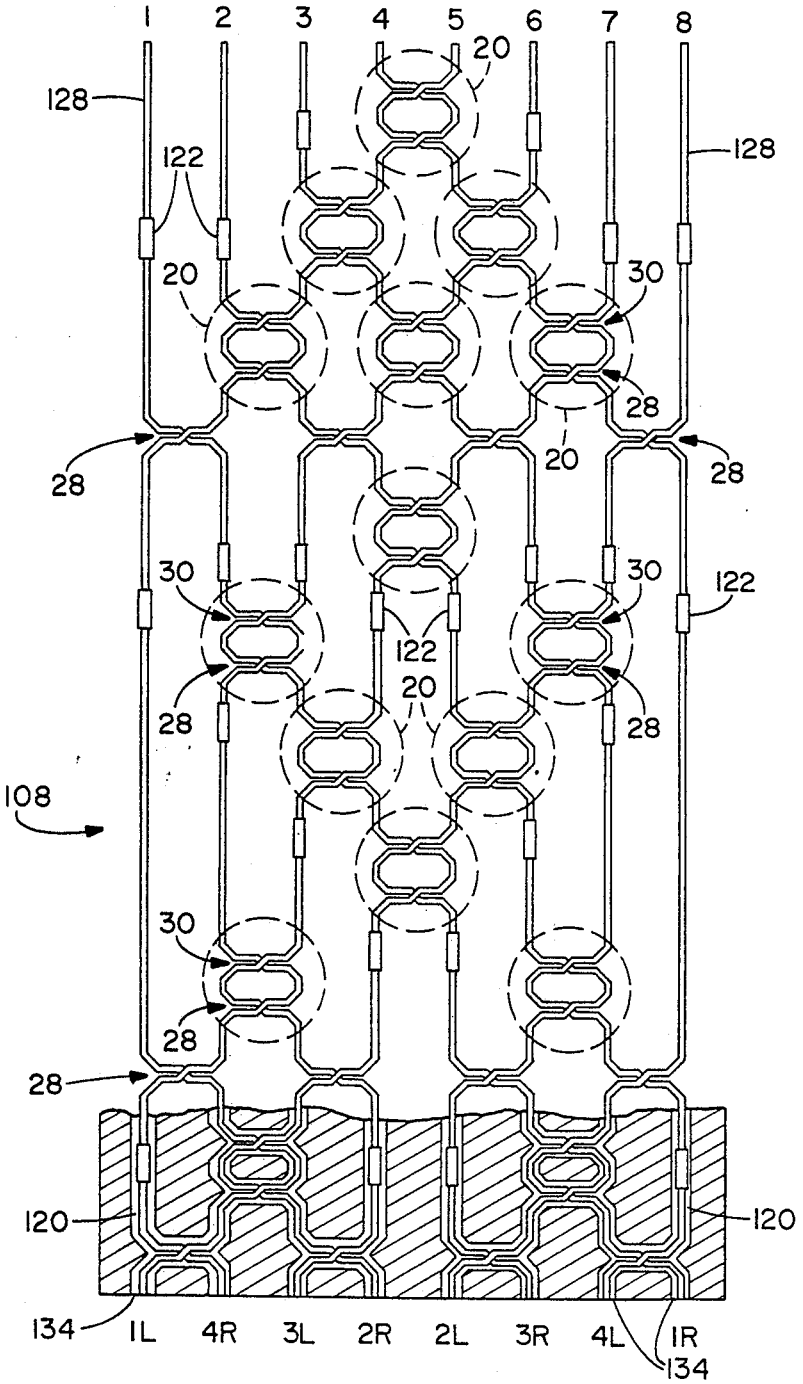
FIG. 11 shows a portion of a sectional view of the assembly of FIG. 10 taken along the line 11—11 beneath a top surface of a baseplate of the assembly to show channels milled therein with center conductors of coaxial transmission lines situate therein, only a portion of the baseplate being shown to simplify a portrayal of a layout of couplers and crossovers constructed by use of the center conductors of the transmission lines.

As may be more readily seen by comparison of FIGS. 1 and 11, the transmission lines 22 (FIG. 1) correspond to the transmission lines 120 (FIG. 11) and, similarly, the center and outer conductors 32 and 40 correspond to the center and outer conductors 116 and 118. In the assembly 108, pairs of transmission lines 120 are coupled together by couplers 28, identical to the coupler 28 disclosed in FIG. 1. Also shown in FIG. 11 are pairs of couplers 28 and 30 arranged in tandem to provide the structure of a crossover 20 identical to that of FIG. 1. The crossovers 20 enable electromagnetic power to cross from one transmission line 120 to an adjacent transmission line 120. Thus, the assembly 108 provides for a matrix of interconnecting paths for the propagation of electromagnetic power among the transmission lines 120, the matrix providing both for a coupling of power as well as for a crossing of power between adjacent waveguides. In particular, it is noted that the matrix of FIG. 11 becomes a Butler matrix upon a construction of each of the couplers 28 and 30 to provide for an even division of power of one transmission line among a pair of output transmission lines with 90 degree phase shift between the two output lines, the Butler matrix being completed by the inclusion of phase shifters 122 disposed within the transmission lines 120 at various locations indicated in FIGS. 11 and 12. While the invention is described particularly for the case of a Butler matrix, it is to be understood that the principles of the invention providing for the construction of a matrix with crossovers between transmission lines in a planar assembly apply also to other matrices of interconnecting transmission lines. Also, it is noted that, while the hybrid couplers 28 and 30 are disclosed in FIG. 11, the teachings of the invention apply equally well, to the substitution of the hybrid coupler 70 in place of the couplers 28 and 30.

Figure 12:
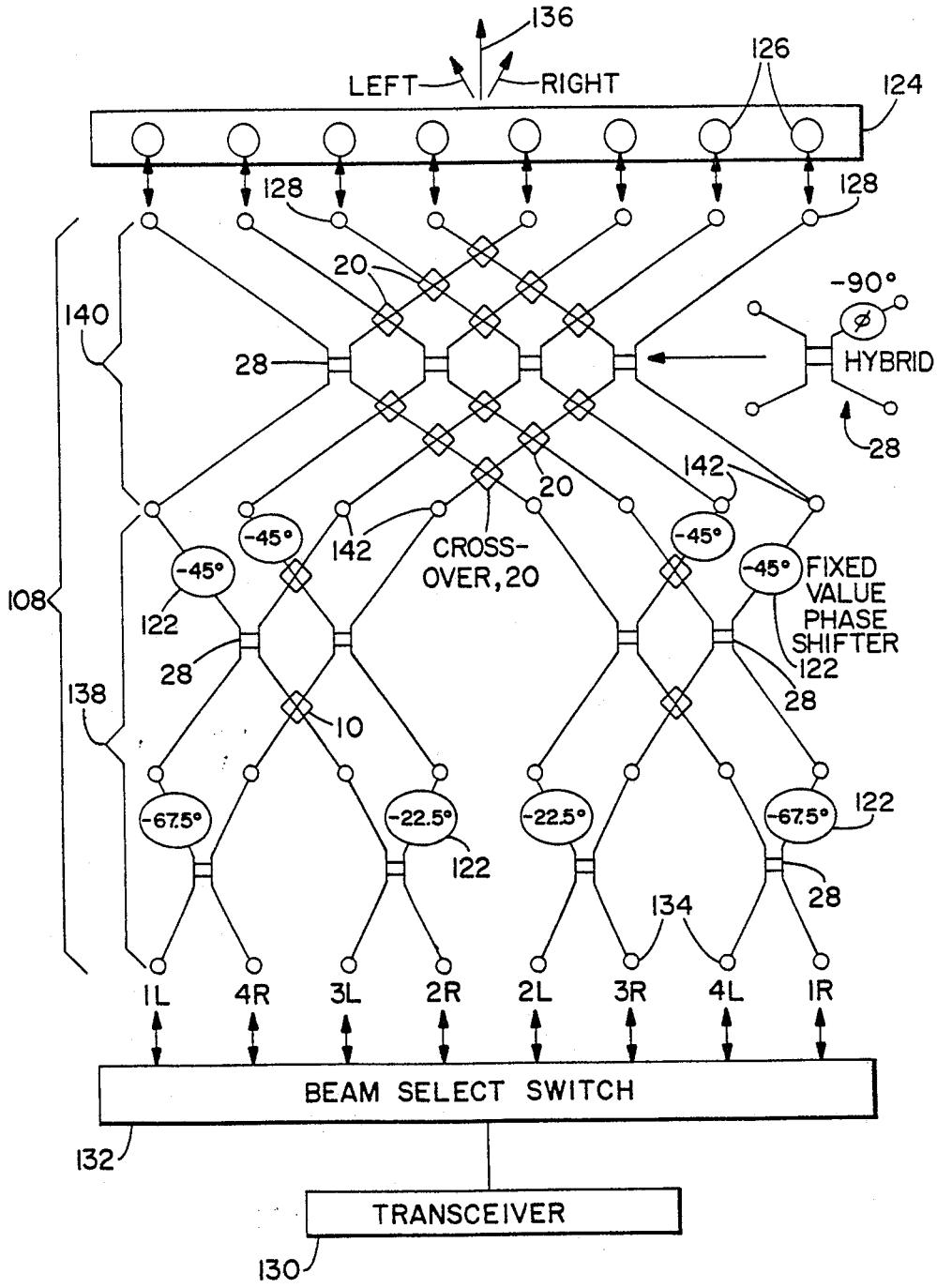
FIG. 12 shows diagrammatically the interconnections of all of the coaxial transmission lines with all of the couplers, crossovers, and phase shifters in a complete Butler matrix employed, by way of example, with an array antenna of eight antenna elements, the physical construction of the matrix of transmission line interconnections being in accordance with that shown in FIG. 11.

The base plate 110, the cover plate 114 and the center conductors 116 are constructed of an electrically conductive material such as aluminum. The general principles of construction of the transmission-line assembly 108 are applicable to any form of planar matrix employing different ratios of power coupled between transmission lines and employing various phase and/or amplitude tapers at a set of output ports resulting from the injection of microwave power at an input port of the assembly 108. By way of example in demonstrating the use of the assembly 108 as a Butler matrix for forming beams of microwave power, FIG. 12 shows an antenna 124 having a linear array of antenna elements or radiators 126, such as horns or dipoles, connected to a set of output ports 128 of the assembly 108. A transceiver 130 is connected by a beam selector switch 132 to a set of input ports 134 of the assembly 108. The number of input ports 134 is equal to the number of output ports 138, this number being eight in the exemplary construction set forth in FIGS. 10–13. By use of the assembly 108 and the selector switch 132, a beam of radiation can be generated at the antenna 124, which beam can be directed to the left or to the right of bore sight 136 as indicated by a set of arrows in front of the antenna 124.

The assembly 108 is formed as a unitary structure by the above-noted milling procedure in which channels 112, including the structures of the channels 50 (FIG. 1) are formed within the base plate 110. The channels 112 extend from an input end of the assembly 108 at the switch 132 (FIG. 12) to an output end of the assembly 108 at the antenna 124. The terms input and output are in reference to the transmission of a signal from the transceiver 130 to the antenna 124, it being understood that the assembly 108 operates reciprocally so that electromagnetic signals can flow equally well from the antenna 124 via the assembly 108 to the switch 132. In the preferred embodiment of the invention, the base plate 110, the cover plate 114 as well as the complete assembly 108 have a planar configuration. If desired, the planar configuration can be altered by constructing the assembly 108 on a slightly curved surface which would permit the emplacement of the assembly 108 within a curved wall of an airframe of an aircraft or satellite, it being understood that such curvature would be sufficiently gradual so as to allow propagation of electromagnetic waves through the transmission lines 20 without significant reflection from such curvature.

The phase shifters 122 are formed as ceramic inserts located in the space between a center conductor 116 and the outer conductor 118. As a convenience to manufacture of the assembly 108, the phase shifters 122 may be provided with a U-shaped cross section allowing the phase shifter to be inserted by pressing the phase shifter 122 down upon a center conductor 116 so that the legs of the U-shaped configuration are slid in position on both sides of the center conductor 116. The phase shifters 122 may be fabricated of ceramic material in which the dielectric constant may be varied among the phase shifters to provide for different amounts of phase shift or, alternatively, additional length of phase shift material may be inserted to provide for differing amounts of phase shift. It is advantageous to form the phase shifters of sections of dielectric which a length, as measured along the center conductor 116, which is equal to a quarter wavelength of radiation propagating along the transmission lines 120, thereby to minimize reflections from the phase shifters 122. If desired, the phase shifters 122 may be made of the same ceramic material employed in construction of the dielectric supports 98 of FIG. 6. The specific values of phase shift of each of the phase shifters 122 are indicated diagrammatically in FIG. 12, each of these values of phase shift being a phase lag, the values of phase shift shown being employed for establishing a uniform phase taper in a Butler matrix. Three values of phase shift are shown, these values being phase lag of 22.5 degrees, 45 degrees, and 67.5 degrees. The values of the phase shifters 122 may also be adjusted to compensate for phase shift which may have been introduced by the crossovers 20.

With reference to the supporting of the center conductors 116 centrally within the channels 112, it is noted that the center conductors 116 may be held in position by dielectric supports such as the dielectric supports 42 (FIG. 1) which hold the center conductors 32 in position. The dielectric supports 42 have been deleted in FIGS. 11–13 in order to facilitate the description of the inventive structure. Preferably, the supports are to be arranged along the center conductors 116 in pairs such that, in each pair, the supports are spaced apart by one quarter of a wavelength of the electromagnetic power to cancel any reflected waves which may result from a discontinuity in the transmission line associated with the physical structure of a support. These may be positioned at intervals along the transmission lines 120 of a few inches. A nominal value of microwave frequency of 4.0 GHz is presumed in this description of the assembly 108, as was disclosed in the description of the crossover 20 of FIGS. 1–9.

In order to demonstrate operation of the assembly 108, the transmission lines 120 at the respective input ports 134 are identified ( FIGS. 11–13) by the legends (1L, 1R) to (4L, 4R) to identify specific ones of the eight beams to be generated by the antenna 124 in response to the application of an electromagnetic wave to any one of the various input ports 134. The numeral 1 indicates a beam which is directed close to boresight 136, while the numerals 2, 3, and 4 represent larger angles of beam inclination relative to boresight 136. The letters L and R indicate orientation of a beam to the left or to the right of boresight 136. In a preferred embodiment of the assembly 108, the transmission lines 120 have the same square cross-sectional dimensions disclosed above in the construction of the crossover 20 (FIGS. 1–9), namely, a side of a channel 112 measuring 0.5 inch while a side of the center conductor 116 measures 0.2 inch.

Figure 13:
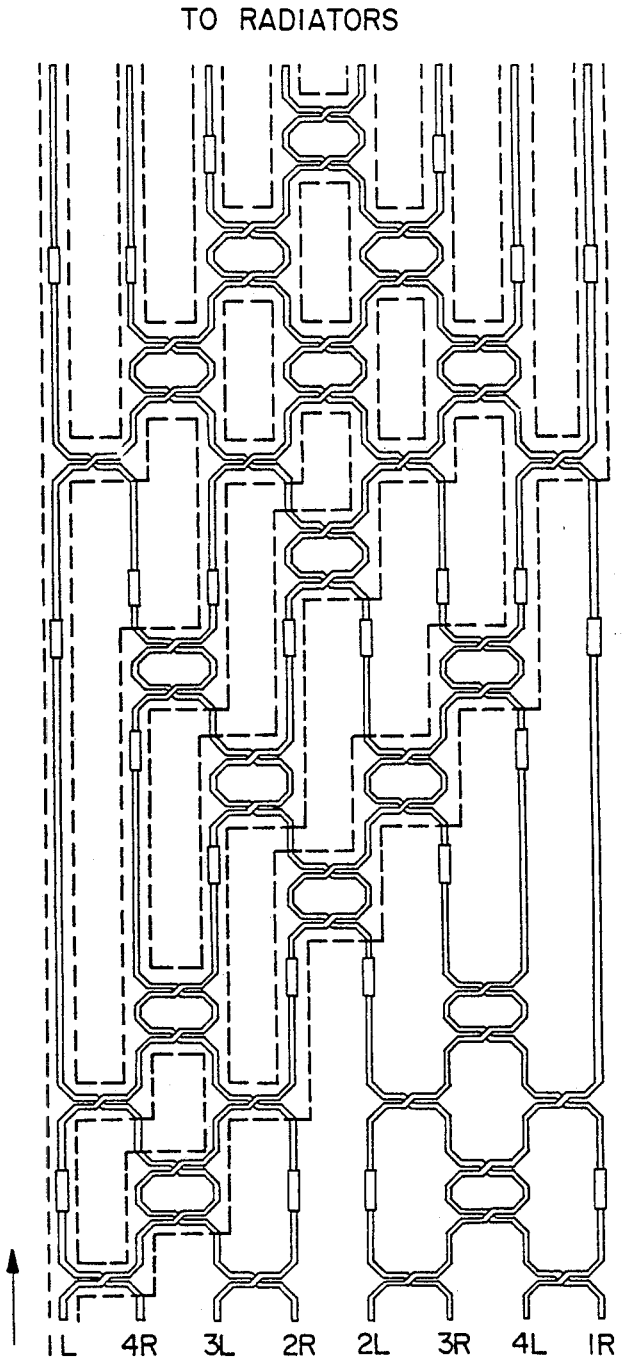
FIG. 13 is constructed in the manner of an overlay with paths of transmission of electromagnetic energy from one input port to all of the output ports of the Butler matrix being shown superposed upon the arrangement of center conductors of FIG. 11.

The operation is described further with reference to the overlay presentation in FIG. 13 wherein a wave of electromagnetic power is incident at the left hand input port 1L. The power travels upward toward the radiators 126, and splits by means of the various couplers 28 among adjacent ones of the transmission lines 120. In addition to the spitting of power, power is directed via the crossovers 20, each crossover comprising the tandem arrangement of two couplers 28 and 30, to additional ones of the transmission line 120 so as to appear at all of the output ports 128. Thus, power splits at the first coupler 28 to flow in equal quantities in the first two transmission lines 120 in the bottom left corner of FIG. 13. The power in the second transmission line crosses over via a crossover 20 into the third transmission line from the left side of FIGS. 11–13. Thereupon, via two of the couplers 28, the power in the first transmission line is divided evenly between the first and the second transmission lines, and the power in the third transmission line is divided evenly between the third and the fourth transmission lines. Each of the first four transmission lines now has one-quarter of the power input at the first of the input ports 134. The waves propagating in the second and the third transmission lines then interchange positions via a crossover 20.

For ease of reference, the diagrammatic representation of the assembly 108 in FIG. 12 is divided into two subassemblies 138 and 140, the subassembly 138 connecting with the switch 132 while the subassembly 140 connects with the antenna 124. The preceding description of the splitting of the power incident at input port 1L among the first four transmission lines 120 provides for a uniform distribution of power at the first four nodes 142 interconnecting the subassemblies 138 and 140. Continuing with the distribution of power from the nodes 142, in the subassembly 140, the power in the first four transmission lines 120 is then coupled via additional ones of the crossovers 20 and additional ones of the couplers 28 to divide evenly among all eight of the output ports 128 of the transmission-line assembly 108. It is readily verified by inspection, that a wave incident at any other one of the input ports 134 subdivides uniformly to exit at all of the output ports 128. In addition, the fixed phase shifts of the phase shifters 122 provide for a uniform phase taper or phase slope among the waves exiting from the output ports 62. These values of phase shift are in addition to the lagging phase shift of 90 degrees provided by each of the hybrid couplers 28.

In FIG. 12, the indicated values of phase shift introduced by the fixed-value phase shifters 122 produce a phase slope of 22.5 degrees between the nodes 142 upon application of an electromagnetic wave to either of the input ports 134 designated 1L and 1R. Much larger values of phase slope are obtained by activation of other ones of the input ports 134. By way of example in the construction of the assembly 108 employing the values of phase shift indicated by the phase shifters 122, the power of an electromagnetic wave input at any one of the input ports 134 is reduced in intensity by 9 dB at each of the output ports 128, with the following phase tapers being attained between successive ones of the output ports 128 in response to excitation at the respective individual ones of the input ports 134, namely: port 1L produces 22.5 degrees lag, port 4R produces 157.5 degrees lead, port 3L produces 112.5 degrees lag, port 2R produces 67.5 degrees lead, port 2L produces 67.5 degrees lag, port 3R produces 112.5 degrees lead, port 4L produces 157.5 degrees lag, and port 1R produces 22.5 degrees lead. It should be noted also that, with respect to the foregoing values of phase slope, the values of phase shift attained for the nodes 142 are symmetrical about a center line of the assembly 108 because of the symmetrical construction of the right and left halves of the assembly 108. The crossovers 20 and the couplers 28 of the subassembly 140 convert the phase taper of four nodes 142 on the right side or the left side to one continuous phase taper across all eight of the output ports 128.

The assembly 108 is readily constructed by milling out the channels 112, as noted above, in the base plate 110. The milling provides for a uniform square cross section for the channels 112 throughout the transmission lines 120, except at locations of couplers 28 and 30 wherein the channel width is enlarged to encompass the central region 52 of each of the couplers 28 and 30. With the use of the coupler 70 in lieu of the couplers 28 and 30, the channels 112 are enlarged in their width at a coupler 70 to encompass the central region 74. In addition, the milling process includes formation of the pockets 102 for receipt of the springs 96, the milling procedure also forming the vanes 106. Thereafter, the center conductors 116 are inserted into the channels 112, the bars 56 and 58 are inserted into the enlarged regions of the channels at the locations of the phase shifters 28 and 30 and, in the case of the use of the couplers 70, the bars 78 and 80 are inserted along with the supports 98 and the springs 96. Thereupon, the construction of the assembly 108 is completed by placing the cover plate 114 on top of the base plate 110.

By virtue of the foregoing construction, the invention has provided a matrix of microwave transmission lines for the distribution and the combination of electromagnetic waves. The construction can be accomplished by automatic milling machinery to provide repeatably accurate assemblies of coaxial transmission lines interconnected by hybrid couplers composed of parallel sections of transmission lines with a notched crossover. The matrix provides for a crossing over of electromagnetic power from one transmission line to another within a common planar structure without the need for any passages for electromagnetic waves located outside of the planar configuration.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A matrix of lines for transmission of electromagnetic power between a first set of ports of said matrix and a second set of ports of said matrix comprising:

a plate extending in longitudinal and transverse directions, ports of said first set of ports being arranged in said plate transversely of each other, ports of said second set of ports being arranged in said plate transversely of each other;

a set of channels arranged side-by-side and disposed in said plate, each of said channels extending in said longitudinal direction of said plate from said first set of ports to said second set of ports, each of said channels having walls extending in spaced-apart relation in said longitudinal direction, walls of said channels serving as outer conductors of coaxial electromagnetic transmission lines;

a set of rods disposed in said channels to serve as center conductors of said coaxial transmission lines;

a set of couplers disposed in said plate, each of said couplers having four ports wherein two of the ports serve as input ports of the coupler and two of the ports serve as output ports of the coupler, a first plurality of said couplers being located between two adjacent ones of said transmission lines and interconnecting said two adjacent transmission lines, a further plurality of said couplers being located between further ones of said transmission lines, a center line of each of said couplers being oriented in said longitudinal direction and being disposed between said two adjacent transmission lines, a first of said input ports and a first of said output ports of a coupler being located on the same side of said center line, a second of said input ports and a second of said output ports of the coupler being located on the opposite side of said center line;

each of said couplers being formed in a section of channel joining with the channels of said two adjacent transmission lines for coupling of power within a plane of said plate, each of said couplers comprising a pair of spaced-apart bars disposed in said section of channel and connecting via said coupler ports with the rods of said two adjacent transmission lines for coupling a portion of electromagnetic power from one of said two adjacent transmission lines to the other of said two adjacent transmission lines; and wherein said couplers are arranged singly, and in tandem pairs between selected adjacent ones of said transmission lines; and in each of said tandem pairs of couplers, the output ports of a first of the couplers are connected to the input ports of a second of the couplers to form a power crossover disposed in the plane of said plate, said power crossover comprising two of said couplers for crossing electromagnetic power between said selected adjacent transmission lines, there being a plurality of said power crossovers and a plurality of said singly arranged couplers providing for a distribution of electromagnetic power between a port of one of said sets of matrix ports and a plurality of ports among a second set of said matrix ports, all coupling of power between said transmission lines being accomplished within the plane of said plate to provide a planar configuration to said matrix.

2. A matrix according to claim 1 wherein said plate is planar.

3. A matrx according to claim 1 wherein said matrix has a generally planar form, and wherein all paths of conduction of electromagnetic power among said crossovers lie within said generally planar form.

4. A matrix according to claim 1 wherein said portion of electromagnetic power coupled by a coupler is one-half of the power.

5. A matrix according to claim 4 wherein each of said couplers introduces a 90 degree phase shift between waves carrying each half of the power.

6. A matrix according to claim 5 wherein said couplers are distributed among said transmission lines to provide for a Butler matrix.

7. A matrix according to claim 6 further comprising phase shifters disposed between a rod and the wall of a channel in each said transmission lines to provide a desired phase taper to electromagnetic waves outputted at a set of said matrix ports.

8. A matrix according to claim 1 wherein each of said couplers is a hybrid coupler and wherein, in each of said crossovers, a first one of said output ports of said first coupler is connected to a first one of said input ports of said second coupler, the second output port of said first coupler is connected to a second input port of said second coupler, said first and said second input ports of said first coupler serving as input ports of said crossover, and said first and said second output ports of said second coupler serving as output ports of said crossover.

9. A matrix according to claim 8 further comprising a cover disposed on said plate for closing said channels, said cover and said plate providing a housing of electrically conductive material for each of said couplers; and wherein in each of said couplers, said housing includes a top wall and a bottom wall, there being a front wall, a back wall, a first sidewall and a second sidewall joining said top wall to said bottom wall, said housing having four openings oriented normally to a common plane, said top wall and said bottom wall being parallel to said common plane, said openings being positioned serially around a center of said housing and pointing outward in different directions; and wherein in each of said couplers, said bars serve as center conductors and extend through each of said openings to form therewith said input ports and said output ports, said first input port and said first output port being located at opposite ends of said first sidewall, said second input port and said second output port being located at opposite ends of said second sidewall, said first input port and said second input port being located at opposite ends of said front wall, and said first output port and said second output port being located on opposite ends of said back wall;

the two bars in each of said coupler electrically connect ports of said first sidewall with ports of said second sidewall, said bars being uniformly positioned apart from each other and from an inner surface of said housing; and each of said couplers further comprises a first one of said bars being twisted about a second one of said bars with a half twist to enable said first bar to interconnect said first input port with said second output port and to enable said second bar to interconnect said second input port with said first output port.

10. A matrix according to claim 9 wherein, in each of said couplers, each of said bars has a central portion, a first end portion, and a second end portion joined by said central portion to said first end portion, said first end portion and said second end portion being straight and of equal length, the central portions of said first and second bars being twisted about each other;

each of said bars has a rectangular cross section and flat outer surfaces, one of said flat surfaces being planar throughout the length of a bar, the sum of the lengths of the two end portions plus the central portion in each of said bars being approximately one-quarter wavelength of radiation propagating through said couplers; and said one planar surface of one of said bars is parallel to said one planar surface of the other of said bars, said half twist retaining the planar configuration of said one planar surface in each of said bars.

11. A matrix according to claim 10 wherein, in each of said bars the central portion of each of said bars has a notch opposite said one planar surface, the notch of a first one of said bars facing and interleaving with the notch of the second one of said second bars;

end portions of each bar are parallel to the front wall and the back wall of said housing; and the central portion in each of said bars is angled relative to said first and said second end portions of the bar to permit an interleaving and crossing configuration of the central portions of both of said bars, thereby to provide for capacitive coupling of electromagnetic waves between said bars.

12. A matrix according to claim 10 wherein, in each of said bars, said central portion has a notch opposite said one planar surface, the notch of said first bar facing and interleaving with the notch of said second bar;

each of said bars has a first and a second extension beyond said first and said second end portions, respectively, the central portion in each of said bars being parallel to a central longitudinal axis of the respective bar, the two extensions of the bar being parallel to and offset to opposite sides of said axis in each of said bars, the axes of the two bars being angled to provide for a crossover of the central portions of each of said bars, said extensions extending through respective ones of said coupler ports.

13. A matrix according to claim 12 wherein, in each of said couplers, and in each bar of a coupler, the central portion is narrowed relative to the extensions of the bar, the two extensions of a bar having a taper extending towards the central portion, the distant portions of said extensions having cross section equal to that of said rods of said transmission lines, and wherein each of said notches is a double stepped notch.

14. A matrix according to claim 13 wherein the depths of the sections of channel of each of said couplers, as measured in a direction perpendicular to said transverse direction, are equal to the depths of the channels of said transmission lines.

15. A matrix according to claim 14 wherein the width of each of said sections of channel in each of said couplers is enlarged in said transverse direction to accommodate the physical shapes of said pair of bars.

* * * * *